US007506755B2

(12) United States Patent
Buse et al.

(10) Patent No.: US 7,506,755 B2
(45) Date of Patent: Mar. 24, 2009

(54) CIGARETTE BOX COMPRISING A HINGED LID

(75) Inventors: Henry Buse, Visselhövede (DE); Viktor Hein, Luttum (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 0 days.

(21) Appl. No.: 11/575,321

(22) PCT Filed: Sep. 8, 2004

(86) PCT No.: PCT/EP2005/009633

§ 371 (c)(1),
(2), (4) Date: Mar. 15, 2007

(87) PCT Pub. No.: WO2006/029752

PCT Pub. Date: Mar. 23, 2006

(65) Prior Publication Data

US 2007/0284267 A1 Dec. 13, 2007

(30) Foreign Application Priority Data

Sep. 16, 2004 (DE) ..... 10 2004 045 279

(51) Int. Cl.
*B65D 85/10* (2006.01)

(52) U.S. Cl. ..... 206/268; 206/273

(58) Field of Classification Search ..... 206/259, 206/261, 265, 268, 271, 273; 229/160.1, 229/146, 148
See application file for complete search history.

(56) References Cited

U.S. PATENT DOCUMENTS

| | | | | |
|---|---|---|---|---|
| 4,753,383 | A | 6/1988 | Focke et al. | |
| 5,143,282 | A | 9/1992 | Pham | |
| 5,435,440 | A * | 7/1995 | Focke et al. | 206/271 |
| 6,457,580 | B1 * | 10/2002 | Focke et al. | 206/259 |
| 2003/0153446 | A1 * | 8/2003 | Focke et al. | 493/51 |
| 2004/0178089 | A1 | 9/2004 | Draghetti | |

FOREIGN PATENT DOCUMENTS

| | | | |
|---|---|---|---|
| DE | 41 03 612 | A1 | 8/1992 |
| EP | 434 962 | A1 | 7/1991 |
| EP | 1 361 986 | B1 | 2/2002 |
| EP | 1 296 813 | B1 | 5/2005 |

* cited by examiner

*Primary Examiner*—Luan K Bui
(74) *Attorney, Agent, or Firm*—Sughrue Mion, PLLC

(57) ABSTRACT

Disclosed is a closing aid for cigarette packs of the hinged lid type, comprising vertical webs (31) of a collar (12) and an inner lid fold (25) located on the interior face of a front wall (19) of the lid. Said inner lid fold (25) is provided with lateral recesses (37) whose relative position is selected such that the threading process of the webs (31) into an interlocked position with the inner lid fold (25) is initiated when a maximum edge pressure is attained on top transversal edges (35) of the collar (12).

7 Claims, 4 Drawing Sheets

Fig. 7
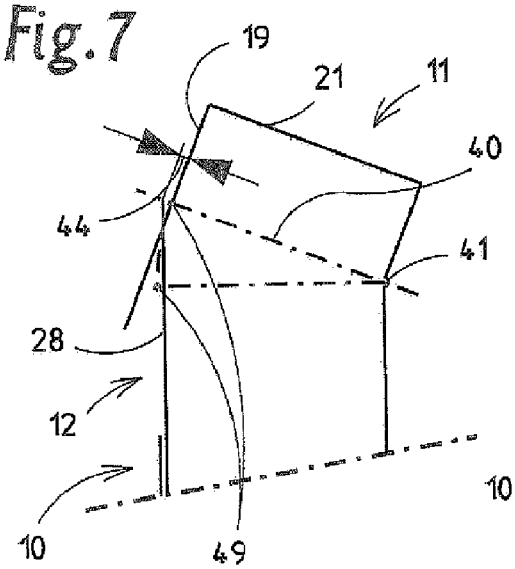
Fig. 8
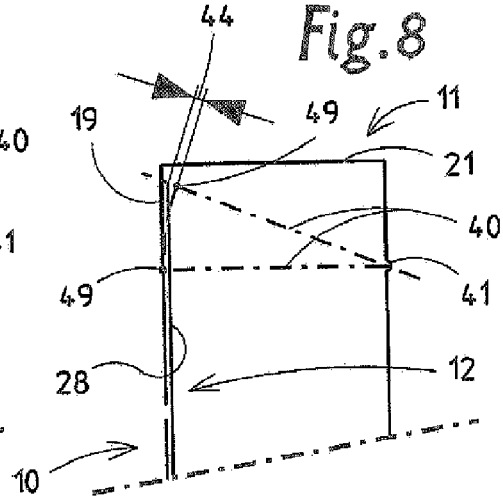
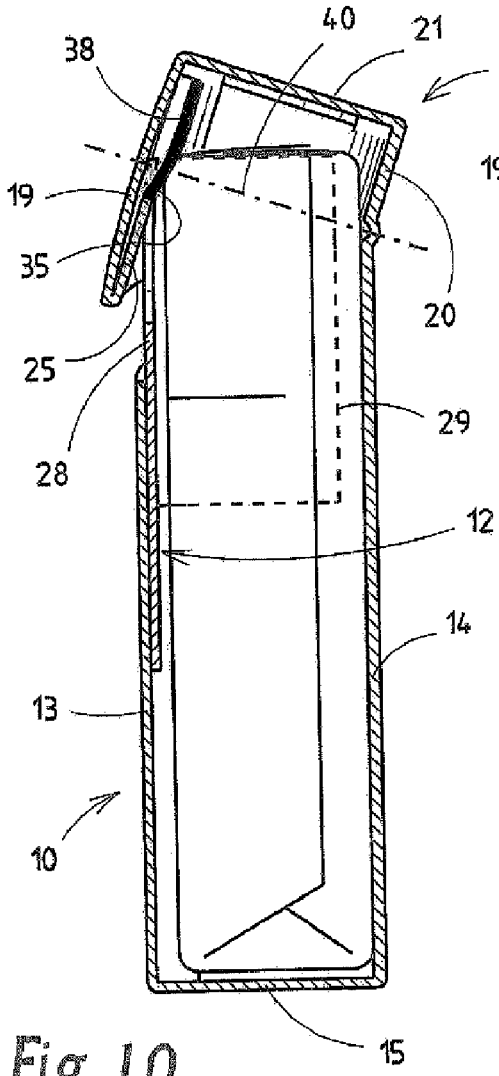
Fig. 10
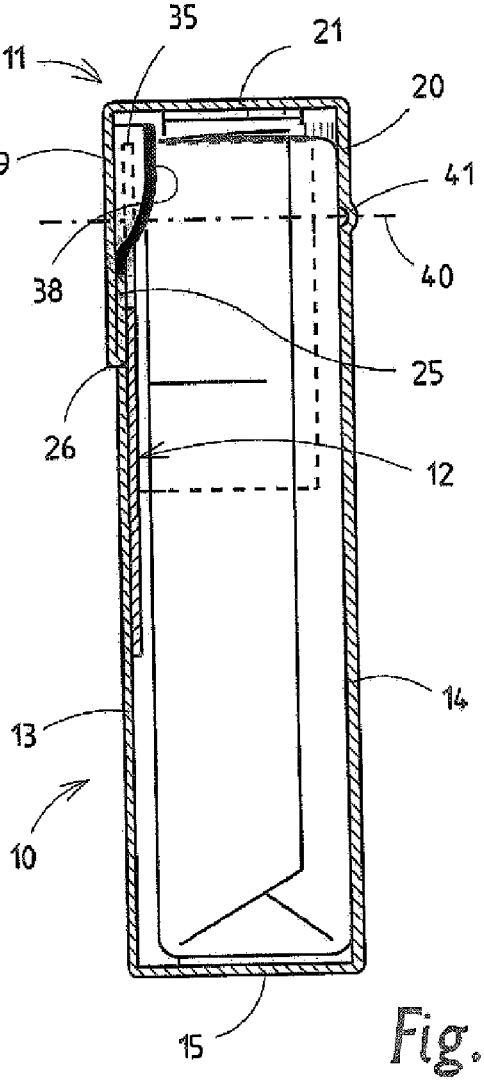
Fig. 9

CIGARETTE BOX COMPRISING A HINGED LID

This application is a 371 of PCT/EP/09633, filled on Sep. 8, 2004.

BACKGROUND OF THE INVENTION

The invention relates to a hinged carton for, in particular, cigarettes, having a carton part, a lid articulately attached to a carton rear wall, and a collar which is disposed in the carton part and has a collar front wall and collar side walls and whose upper region projecting from the carton part, in the closing position, is embraced by the lid and whose collar front wall has webs for the delimitation of a recess, wherein attached to the inner side of a lid front wall is a lid inner tab, which on at least one side margin has a recess into which a web of the collar front wall enters in such a way when the lid is closed that a partial area of the web makes its way into the region between the lid inner tab and the lid front wall.

The recesses disposed on, preferably, both side margins of the lid inner tab serve, in conjunction with the webs of the collar front wall, as a closing aid for the lid (EP 0 434 962 B1). The invention is concerned with improving the aforesaid closing aid.

The object of the invention is accordingly to configure a hinged carton with closing aid such that the process of introducing the webs of the collar front wall into the interlocking position is reliably ensured even after repeated opening of the hinged lid.

SUMMARY OF THE INVENTION

For the achievement of this object, the hinged carton according to the invention is characterized in that the relative position of the recess is chosen such that the entry of the web into the interlocking position is initiated once a maximum edge pressure against the collar is reached, the edge pressure being determined by bearing contact of the lid front wall or of the lid inner tab against an upper transverse edge of the collar during the closing motion of the lid.

The invention is based on the recognition that, during the closing motion of the lid, an optimal position is given for the start of the threading of the webs of the collar into the interlocking position. This is given when, during the closing operation, a maximum edge pressure is in force in the region of the upper, transversely directed edges of the collar front wall, i.e. in the region of upper transverse edges. At the moment of this maximum edge pressure, according to the invention an upper margin of the webs, namely a rounding of the same, must be at a set position within the recess of the lid inner tab.

According to the invention, the maximum edge pressure is geometrically definable, namely is given when an (imaginary) reference plane, which runs through a joint, namely a linear joint, between the lid and the carton part on the one hand, and through the transverse edges of the collar on the other hand, is directed parallel to an upper end wall of the lid.

In addition, structural interrelationships of the pack are of importance, namely a compression measure, in order that a sufficient (maximum) edge pressure is applied to the lid inner tab at the moment of threading of the interlocking members. The compression measure is the (theoretical) deformation of the upper, free region of the collar or of the collar front wall as the lid is opened and closed.

A further peculiarity of the invention is the shaping of the recesses, namely the contour of the same, out of a plurality of successive circular-arc-shaped recess edges.

BRIF DESCRIPTION OF THE DRAWINGS

Further details of the invention are explained in greater detail below with reference to the drawings, in which.

Figure 3:
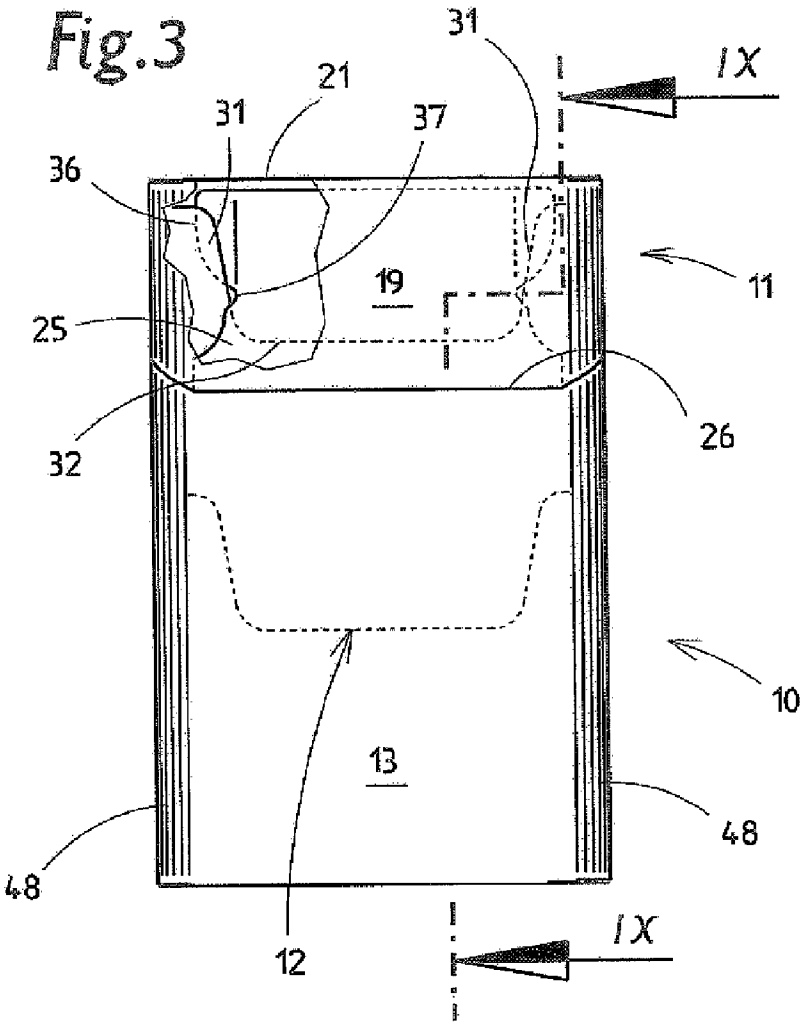
Figure 4:
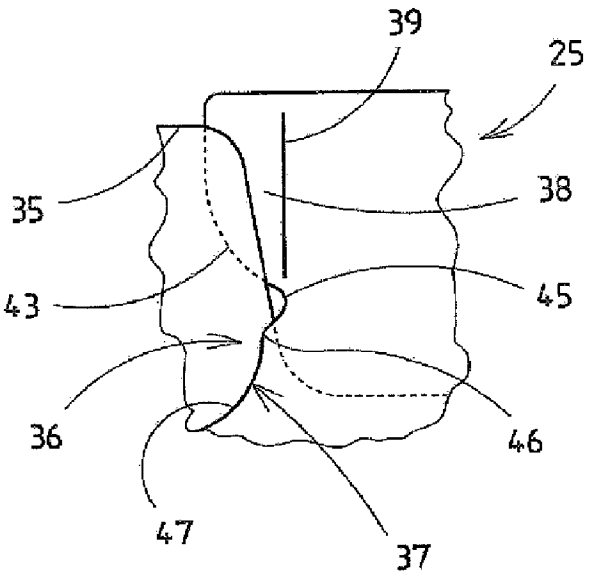
Figure 5:
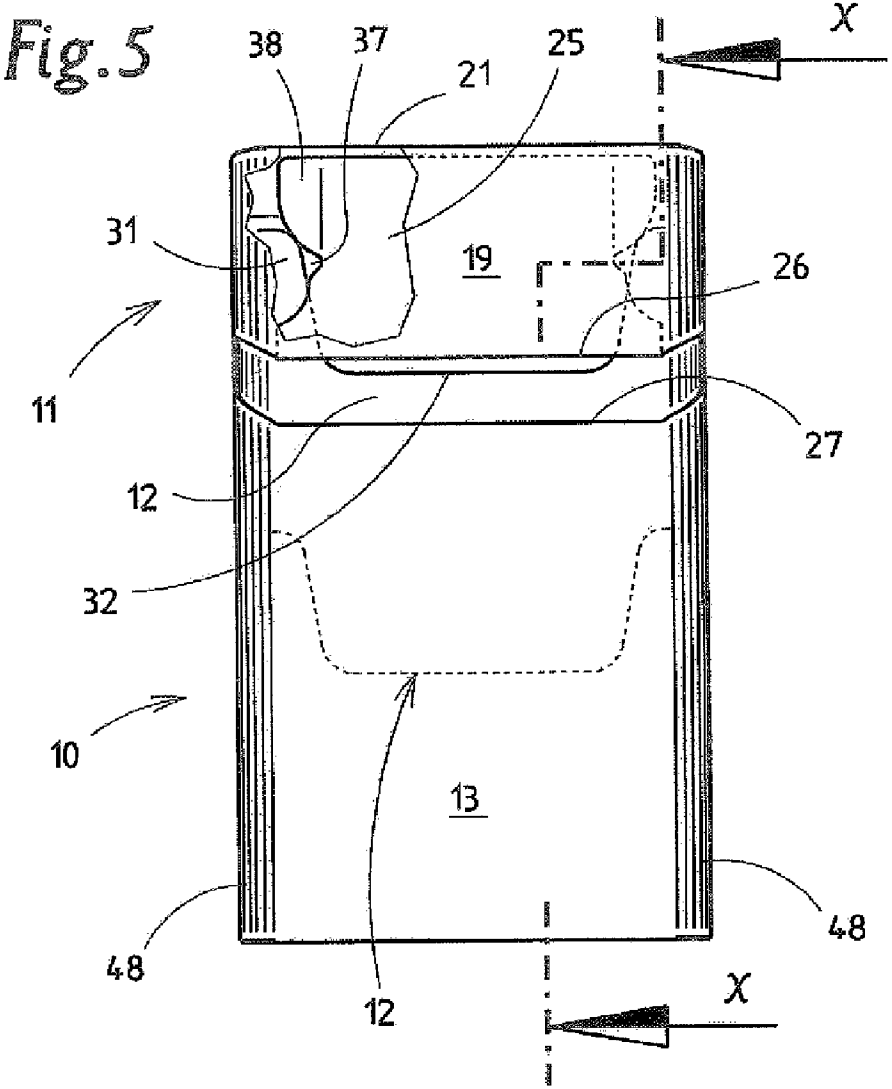
Figure 6:
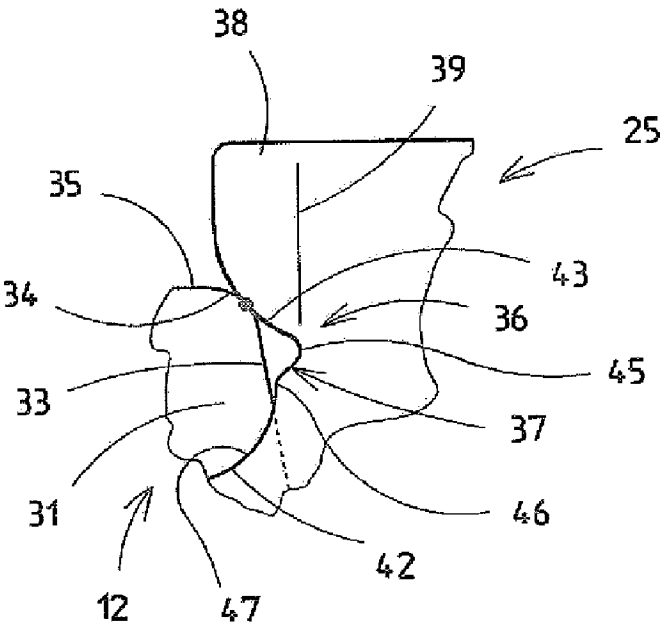

FIG. 3 shows a closed hinged carton in front view with tear-out in the region of the lid for the representation of a closing aid, FIG. 4 shows the closing aid shown in FIG. 3 on an enlarged scale in interlocking position, FIG. 5 shows a hinged carton with tear-out in the region of the lid, analogous to FIG. 3, with partially open lid, FIG. 6 shows the closing aid shown in FIG. 4 on an enlarged scale, namely at the start of the threading of the interlocking members, FIG. 7 shows a schematic representation of an upper, lid-side part of a hinged carton with partially open lid, in side view, FIG. 8 shows a representation in accordance with FIG. 7, with closed lid, FIG. 9 shows the pack according to FIG. 3 in vertical section in the sectional plane

IX-IX,

FIG. 10 shows the hinged carton according to FIG. 5 in vertical section in the sectional plane X-X in FIG. 5.

DETAILED DESCRIPTION OF THE INVENTION

The hinged carton represented in the drawings usually consists of a (lower) carton part 10 and an (upper) lid 11. In addition, a collar 12 is part of the hinged carton.

Figure 1:
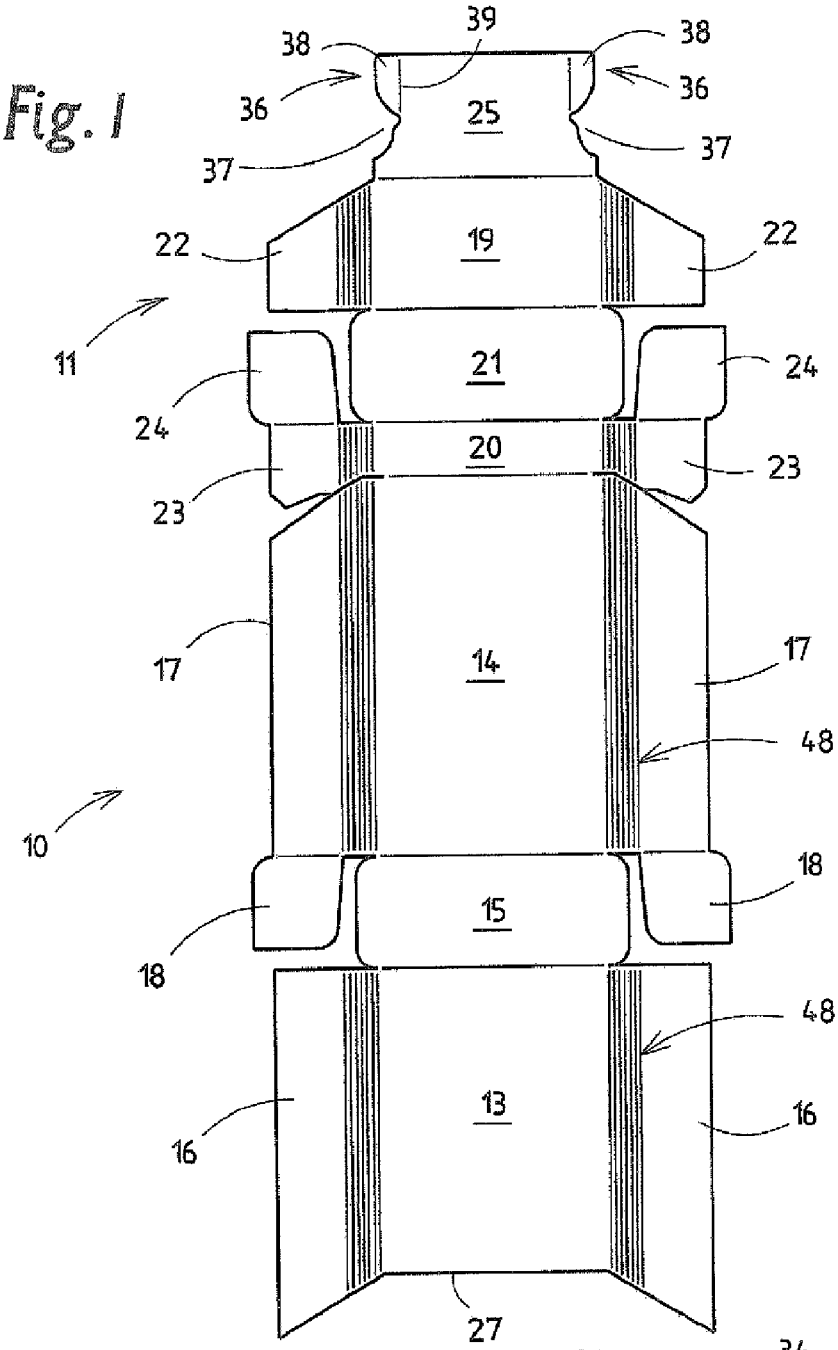
FIG. 1 shows a spread-out blank for a hinged carton with closing aid.

The carton part 10 and the lid 11 consist of a one-piece blank (FIG. 1) having precut regions for the formation of a carton front wall 13, carton rear wall 14 and base wall 15. The carton front wall 13 and the carton rear wall 14 respectively have (outer) side tabs 16 and (inner) side tabs 17 disposed on both sides. On the inner side tabs 17 in extension of the same, base corner tabs 18 are formed, which, in the case of the folded, finished hinged carton, bear against the base wall 15 on the inside.

Analogously, the lid 11 consists of a lid front wall 19, a lid rear wall 20 and an end wall 21. The lid front wall 19 and the lid rear wall 20 have lid side tabs 22 and lid side tabs 23. These form lid side walls. Attached to the lid side tabs 23 are lid corner tabs 24, which bear against the inner side of the end wall 21.

On the free margin of the lid front wall 19 there is a lid inner tab 25. In the finished pack, this bears against the inner side of the lid front wall 19. A common folding edge forms a frontal lid closing edge 26 of the lid 11. When the lid 11 is closed, said closing edge bears against a counter-closing edge 27 serving as the upper limit of the carton front wall 13.

Figure 2:
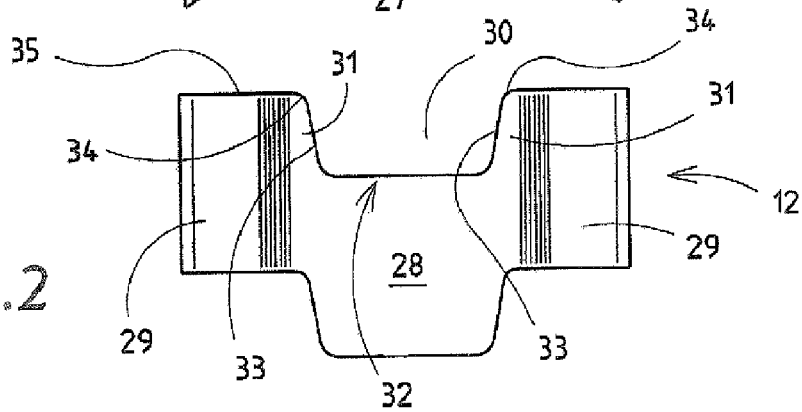
FIG. 2 shows a blank for a collar.

The collar 12, consisting of a separate blank (FIG. 2), forms a collar front wall 28 and collar side tabs 29. In the finished hinged carton, the collar front wall 28 bears against the carton front wall 13 on the inside. The collar side tabs 29 are supported against the carton side walls, namely against the internal side tabs 17. The collar 12 is connected to the carton part 10 in such a way that an upper collar piece juts out from the carton part 10. This collar piece is embraced by the lid 11 in the closing position, so that an upper part of the collar front wall 28 bears against the lid inner tab 25.

In the region of the collar front wall 28, the collar 12 has an indentation 30. This is delimited by lateral webs 31. An (upper) contoured collar edge 32 forms in the region of the webs 31 obliquely directed, upwardly diverging, substantially vertical web edges 33. These are respectively adjoined by a circular-arc-shaped transition 34 into transversely or horizontally directed transverse edges 35, which extend to the margin of the collar side tabs 29.

In interaction with the lid 11, namely the lid inner tab 25, the collar 12 forms a closing aid to ensure an exact closing position of the lid (FIG. 3, FIG. 9). For this purpose, the lid inner tab 25 is configured such that a mutual engagement, namely an interlocking, with the collar 12 takes place, to be precise with the marginal webs 31. The lid inner tab 25 is provided with contoured side margins 36. These respectively define recesses 37 on both sides of the lid inner tab 25. The aim of the closing aid is an interlocking of the webs 31 with the lid inner tab 25 or with a marginal clamping tab 38, adjoining the recess 37, of the lid inner tab 25. The clamping tab 38 is demarcated from the other part of the lid inner tab 25 by an embossed line 39. At least in the region of the clamping tab 38, the lid inner tab 25 is not glued to the lid front wall 19. In the clamping position of the closed lid, an upper part-region of the webs 31, facing the transverse edge 35, lies between the clamping tab 38 and the lid front wall 19, i.e. in a clamping position (FIG. 4).

The point is that, even after repeated actuation of the lid 11 in the closing motion, the clamping or interlocking position between the collar 12 and the lid 11 is reliably ensured. For this purpose, an exact relative position of the recesses 37 is provided, to be precise in dependence on the dimensions of the hinged carton. It is imperative that, at the moment of a maximum edge compression against the transverse edges 35 of the collar 12, the interlocking position of the webs 31 is threaded into place (FIG. 6). The transition 34 of the webs 31 lies in this phase congruent with the rounded part-edge 43 of the clamping flap 38.

The edge pressure or edge compression is, according to definition, the pressure applied by the lid 11 during the closing motion to the transverse edges 35 of the collar 12 due to bearing contact of the lid front wall 19 or lid inner tab 25 against the transverse edges 35. The position of the lid 11 when the maximum edge pressure is reached is geometrically representable. For this, an imaginary transverse plane, namely a reference plane 40, should be taken into account. This extends through a linear joint 41, formed on the rear side of the pack, for the pivotable connection of the lid 11 to the carton part 10 in the region of the lid rear wall 20 and carton rear wall 14. Opposite thereto, the reference plane 40 runs along the upper transverse edges 35 of the lid front wall 19. The maximum edge pressure, i.e. the pressure exerted in the region of the transverse edges 35 by the inner side of the lid front wall 19, is given when the end wall 21 of the lid 11 is directed parallel to the defined reference plane 40. In terms of their relative position, the recesses 37 are positioned in such a way on the lid inner tab 25 that, when the defined maximum edge pressure is reached, the process of threading the interlocking members 31, 38 into place is initiated. This position is shown in FIG. 5. In this position, the webs 31 bear essentially with the region of the (round) transition 34 under elevated pressure against the inner side of the lid front wall 19, to be precise firstly in a region outside the lid inner tab 25 or in the region of the recess 37. The contact pressure of the upper contour of the webs 31 against the inner side of the lid inner tab 25 serves to ensure that, as the closing motion continues, a region of the web 31, which region is particularly discernible in FIG. 4, pushes under the clamping tab 38.

For the process of the secure threading of the interlocking members, a specific edge pressure is necessary. To ensure that this is given irrespective of the dimensions of the hinged carton, the latter must have a specific, selectable compression measure 44. This is obtained from the geometric specifications of the hinged carton, namely the width and depth of the end wall 21 on the one hand, and the height of the lid rear wall 20 on the other hand. The compression measure 44 represented in FIG. 7 and FIG. 8 on the basis of schematized hinged cartons is the distance between the upper limits, i.e. the upper transverse edges 35 of the collar front wall 28, and a reference point 49 of the lid front wall 19. This (imaginary) reference point 49 is located on the inner side of the lid front wall 19 or of the lid inner tab 25, to be precise level with the reference plane 40 with a closed lid 11 (FIG. 8). As the lid is opened—and, conversely, as it is closed—the reference point 49 shifts on a circular-arc-shaped path, so that, when the transverse edges 35 of the collar front wall 28 are reached, an (imaginary) offset between the reference point 49 and the transverse edges 35 is given. This distance is the compression measure 44, which produces a corresponding deformation of the upper region of the webs 31 and hence the generation of a sufficient edge compression to induce the interlocking position. The compression measure 44 amounts to between 0.5 mm and 2.5 mm. A range from 0.8 mm to 1.6 mm is optimal.

A further peculiarity is the shaping of the recesses 37, i.e. the course of the side margins 36 of the lid inner tab 25. The clamping tab 38 is delimited by the circular part-edge 43. This passes into an inner edge 45 as the deepest region of the recess 37. The inner edge 45 is likewise configured in a circular-arc shape, in the opposite direction to the part-edge 43. There then follows an outwardly directed or sideways directed arc-shaped projection 46. This produces a (second) clamping edge for the web 31 (FIG. 4). The projection 46 is adjoined by a further circular-arc-shaped edge piece 47 as the bottom closure of the recess 37. The dimensions of the recesses 37 are chosen such that the webs 31 extend in the region of the indentation formed by the inner edge 45, yet at a distance from the inner edge 45 (FIG. 4). The aim is to ensure that, during the threading of the interlocking members and/or in their end position, no pressure is transmitted to the collar 12 or to the free edges of the webs 31. For the improvement and securement of the threading, the clamping tabs 38 can be preformed, namely prefolded, along the embossed line 39.

Particularly advantageous is the described closing aid for hinged cartons having round edges 48, i.e. having rounded, vertical pack edges. As pack content, a cigarette block 50 is shown, i.e. a group of cigarettes wrapped in a paper or tin-foil inner blank.

Revised relative to the original version of 16 Sep. 2004

REFERENCE SYMBOL LIST 10 carton part
11 lid
12 collar
13 carton front wall
14 carton rear wall
15 base wall
16 side tab (external)
17 side tab (internal)
18 base corner tab
19 lid front wall
20 lid rear wall
21 end wall
22 lid side tab (a)
23 lid side tab (i)
24 lid corner tab
25 lid inner tab
26 lid closing edge

27 counter-closing edge
28 collar front wall
29 collar side tab
30 indentation
31 web
32 collar edge
33 web edge
34 transition
35 transverse edge
36 side margin
37 recess
38 clamping tab
39 embossed line
40 reference plane
41 linear joint
43 part-edge
44 compression measure
45 inner edge
46 projection
47 edge piece
48 round edge
49 reference point
50 cigarette block

The invention claimed is:

1. A hinged carton for cigarettes, having a carton part (10), a lid (11) articulately attached to a carton rear wall (14), and a collar (12) which is disposed in the carton part (10) and has a collar front wall (28) and collar side walls (29) and whose region projecting from the carton part (10), in the closing position, is embraced by the lid (11) and whose collar front wall (28) has webs (31) for the delimitation of an indentation (30), there being attached to the inner side of a lid front wall (19) a lid inner tab (25), which on at least one side margin (36) has a recess (37) into which a web (31) of the collar front wall (28) can be inserted in such a way that a part-area of the web (31) is in a region between the lid inner tab (25) and the lid front wall (19), characterized by the following features:

a) the recess (37) has a relative position such that threading of the web (31) into an interlocking position between the lid inner tab (25) and the lid front wall (19) is initiated once a maximum edge pressure against the collar (12) is achieved, b) the maximum edge pressure is determined by bearing contact of the lid front wall (19) or of the lid inner tab (25) against an upper transverse edge (35) of the collar front wall (28) during the closing motion of the lid (11), and c) the maximum edge pressure is achieved when an imaginary transverse line or transverse plane, namely a reference plane (40), which extends between the transverse edge (35) of the collar front wall (28) and a lid joint or linear joint (41) between the lid (11) and the carton part (10), runs temporarily parallel to an end wall (21) of the lid (11).

2. The hinged carton as claimed in claim 1, characterized in that the initiation of the threading of the web (31) into the interlocking position is determined by a congruent relative position of a rounded transition (34) of the web (31) with an inwardly directed, likewise rounded part-edge (43) of a clamping tab (38) of the lid inner tab (25).

3. The hinged carton as claimed in claim 1, characterized in that a compression measure (44) between the lid front wall (19) and the collar front wall (28) amounts to between 0.5 mm and 2.0 mm, the compression measure (44) corresponding to an imaginary deformation of an upper region of the collar front wall (28) when the maximum edge pressure is reached.

4. The hinged carton as claimed in claim 2, characterized in that the clamping tab (38) delimited by the recess (37) is bounded by an embossed line (39) and is preformed by folding.

5. The hinged carton as claimed in claim 2, characterized in that the recess (37) is delimited by a circular-arc-shaped part edge (43) as the limit of the clamping tab (38), by an adjoining circular-arc-shaped inner edge (45) for the formation of an indentation, and subsequently by a likewise circular-arc-shaped edge piece (47).

6. The hinged carton as claimed in claim 5, characterized in that, adjoining the inner limit of the inner edge (45) forming the recess (37), a projection (46) is formed within the recess (37), which projection defines a contact region of the lid inner tab (25) against the web (31).

7. The hinged carton as claimed in claim 3, wherein the compression measure (44) amounts to between 0.8 mm and 1.6 mm.

* * * * *